United States Patent [19]

Brandon

[11] 3,994,310

[45] Nov. 30, 1976

[54] DUCT CLEANING APPARATUS

[76] Inventor: John H. Brandon, 450 Maple Ave., Pittsburgh, Pa. 15218

[22] Filed: Nov. 11, 1975

[21] Appl. No.: 630,918

[52] U.S. Cl. ..... 134/167 C; 134/179; 134/183; 239/246; 239/288.3

[51] Int. Cl.[2] ..... B08B 3/02; B08B 9/02

[58] Field of Search ..... 239/288, 288.3, 246, 239/251, 601; 134/22 C, 24, 166 C, 167 C, 168 C, 169 C, 179, 167 R, 182, 183

[56] References Cited

UNITED STATES PATENTS

| | | | |
|---|---|---|---|
| 1,779,983 | 10/1930 | Roach | 239/246 X |
| 2,217,360 | 10/1940 | Court | 134/24 UX |
| 3,030,030 | 4/1962 | Rosenkranz | 239/246 X |
| 3,266,737 | 8/1966 | Nees | 239/601 X |
| 3,595,256 | 7/1971 | Waltman et al. | 134/167 R |

*Primary Examiner*—Robert L. Bleutge
*Attorney, Agent, or Firm*—Buell, Blenko & Ziesenheim

[57] ABSTRACT

An apparatus for cleaning debris from ducts. The apparatus has a pair of rotatable jets with one of the jets having a zero orifice and the other jet having a spread orifice. A means supports the jets and fluid is supplied to them. Fluid leaving the jet having the zero orifice impinges the debris and cuts it from the duct and fluid leaving the other jet having the spread orifice produces a flushing action removing the debris after it has been cut from the duct.

5 Claims, 3 Drawing Figures

DUCT CLEANING APPARATUS

This invention relates to a duct cleaning apparatus which employs the use of fluid to cut and flush debris from ductwork.

THE PROBLEM PRESENTED TO THE INVENTOR AND THE PRIOR ART

There are ducts in ventilating, air conditioning and exhaust systems which accumulate debris in the form of grease, dirt, dust or other miscellaneous material. These ducts must be periodically cleaned. Presently they are cleaned manually by using a hose with a nozzle having fluid supplied to it which strikes and removes the debris from the duct. This system is not efficient nor is it as effective as desired and a more efficient apparatus with greater cleaning capability in a shorter time is required. Furthermore, the manual system is limited in the length of the duct that can be cleaned.

THE INVENTOR'S SOLUTION TO THE PROBLEM

I have invented a duct cleaning apparatus employing a pair of rotatable jets, one jet has a zero orifice and the other jet has a spread orifice. When fluid is applied to the pair of jets they rotate and the fluid leaving the jet having the zero orifice impinges on the debris accumulated in the duct and cuts the debris while the second jet having the spread orifice acts in a manner to flush the debris away from the surface of the duct.

Long ductwork can be cleaned because the apparatus can be moved the entire length of the duct and the operator is not required to see the apparatus as it moves along the entire length of the duct.

I provide a duct cleaning apparatus comprising a first rotatable jet and a second rotatable jet forming a pair of jets, the first jet having a zero orifice and the second jet having a spread orifice; and means supporting the pair of jets and supplying fluid to them causing the jets to rotate with the first jet producing a cutting action by the fluid impinging against debris on the duct and the second jet producing a flushing action of the debris after it has been cut by the first jet.

I preferably provide that the two jets are coupled together and are positioned in relatively opposite directions.

I also provide a guard means spaced from the jets to protect the jets from striking the duct as the jets are passed through the ductwork.

This structure provides a more efficient and effective technique for cleaning grease and other debris from the internal walls of ductwork and enables the cleaning of ducts previously which were not accessible by manual cleaning which required the operator to see and position a nozzle emitting fluid striking the debris.

A DETAILED DESCRIPTION OF THE DRAWINGS

A DESCRIPTION OF THE STRUCTURE

A. The Pair of Rotatable Jets

Figure 1:
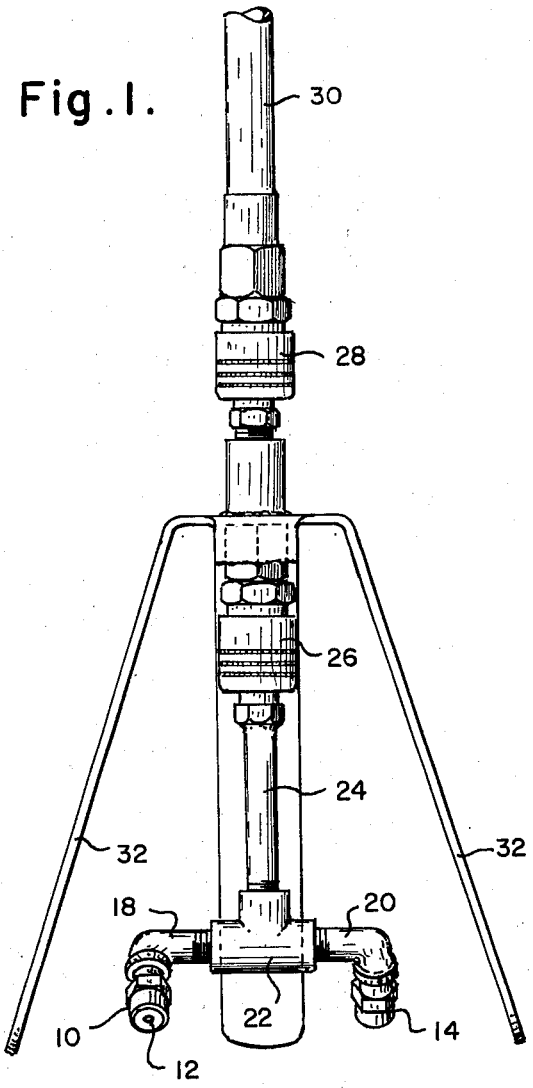
FIG. 1 is a side elevational view of the apparatus.

A first rotatable jet 10 has a zero orifice 12. A second rotatable jet 14 has a spread orifice 16 which is spread approximately 65° and is designed to provide a flare of liquid to a wide sweep. Jets 10 and 14 each have 90° elbows 18 and 20 respectively which are coupled to a tee 22.

B. Means Supporting the Pair of Jets

The means supporting the pair of jets includes the elbows 18 and 20 which are coupled to the tee 22. The stem of the tee is coupled to a tube 24 which has a rotational coupling 26. Another coupling 28 is coupled to the rotational coupling 26. Coupled to the coupling 28 is a high pressure supply line 30 to which any suitable fluid, air or liquid is applied.

C. Means Spaced from the Jets to Protect them from Striking the Duct

A plurality of metal strips 32 are connected to the means supporting the pair of jets and extend downwardly and outwardly and act as a guard to prevent the jets 10 and 14 from striking against a duct wall. The metal strips 32 are spaced in such a manner as to permit the least amount of interruption of the fluid leaving the jets.

THE OPERATION

Figure 3:
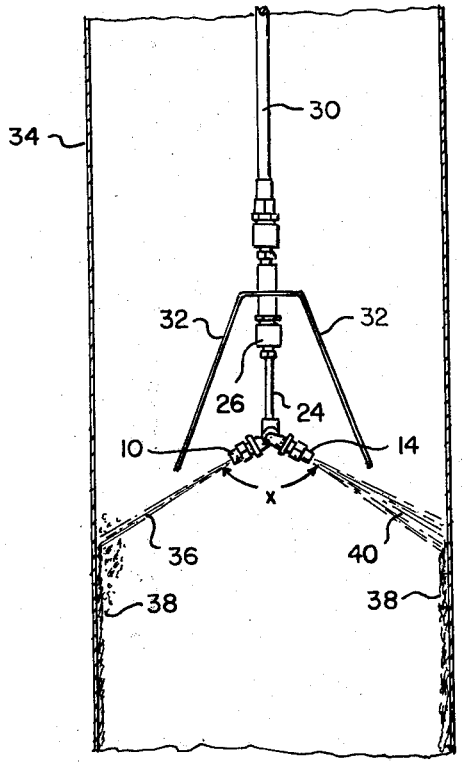
FIG. 3 shows a diagrammatic illustration of the apparatus within the duct being cleaned.
Figure 2:
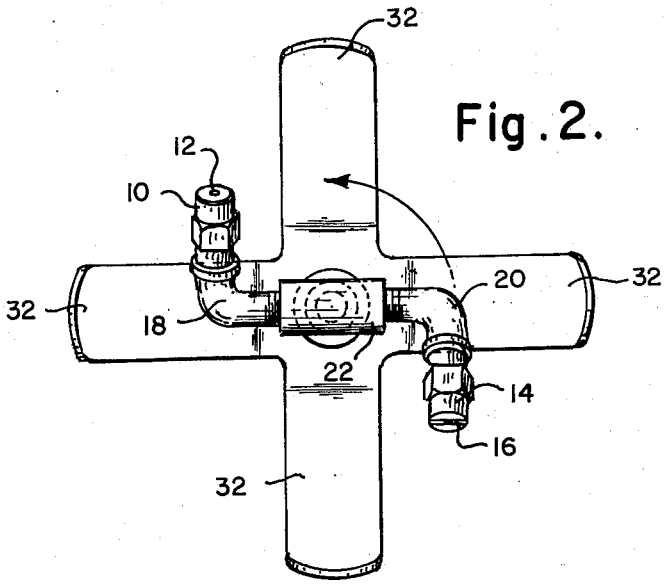
FIG. 2 is a bottom plan view of the invention taken on the line II—II of FIG. 1.

FIG. 3 shows the cleaning apparatus being lowered into a duct 34. High pressure fluid which can be in the form of a liquid is supplied to the high pressure supply line 30 and the pair of rotatable jets 10 and 14 rotate as shown by the arrow in FIG. 2. The revolving speed of the jets can be varied according to the angle X (FIG. 3) between the jets 10 and 14 and/or the pressure of the fluid within supply line 30. This is sometimes referred to as the angle of attack of the jets. The speed of rotation of the pair of jets ranges between 10 rpm and 200 rpm. Each 5° of angle X shown (FIG. 3) results in a change of 50 rpm of the pair of jets. This speed is adjusted to accommodate the various cohesive qualities of the material to be removed from the ducts. The jet 10 having a zero orifice produces a cutting action by the fluid 36 which strikes the debris 38. The debris 38 which is cut is then flushed away by the action of the fluid 40 leaving the jet 14 having a 65° spread. As the work progresses in the ductwork the apparatus is lowered downwardly by the high pressure supply line 30.

This structure enables ductwork to be cleaned which has been considered heretofore inaccessible and provides a more efficient, economical and facile technique and apparatus for cleaning ductwork.

I claim:

1. An apparatus for cleaning a duct comprising:

a. a first rotatable jet and a second rotatable jet forming a pair of jets, the first jet having a zero orifice and the second jet having a spread orifice, the two jets are positioned to have a range of angles with respect to each other to rotate the pair of jets in a range between 10 rpm to 200 rpm;

b. means supporting the pair of jets and supplying fluid to them causing the jets to rotate between 10 rpm to 200 rpm with the first jet producing a cutting action by the fluid impinging against debris within the duct and the second jet producing a flushing action of the debris after it has been cut by the first jet; and c. a guard means coupled to the means supporting and spaced from the jets which remains stationary with respect to the rotating jets, the guard means protects the jets from striking the duct, the jets are located substantially within a longitudinal dimension of the guard means when the jets are in their operating position, during operation the jets are positioned so that fluid leaving the jets passes below the guard means which avoids interruption of the fluid between the jet and the duct.

2. An apparatus as recited in claim 1 wherein a means couples the two jets together and the jets are positioned in relatively opposite directions.

3. An apparatus as recited in claim 2 wherein the means coupling the pair of jets together includes a tee with a pair of adjustable 90° elbows coupling the jets which are used to vary the respective angles between the jets to regulate the rotational speed of the pair of jets and wherein the means supporting the pair of jets includes a rotational coupling.

4. An apparatus as recited in claim 1 wherein the orifice of the second jet has a 65° spread.

5. An apparatus as recited in claim 1 wherein the guard means includes a plurality of strips joined at one end to the means supporting the pair of jets and spaced from the jets.

* * * * *